US005172425A

United States Patent [19]

Smith

[11] Patent Number: 5,172,425

[45] Date of Patent: Dec. 22, 1992

[54] FLEXUS MAXIMUS KNEE JOINT FOR GOALTENDER'S LEG PAD

[76] Inventor: Peter B. Smith, 56 Harvester Ave., Batavia, N.Y. 14020

[21] Appl. No.: 793,584

[22] Filed: Nov. 18, 1991

Related U.S. Application Data

[63] Continuation-in-part of Ser. No. 604,074, Oct. 29, 1990, abandoned.

[51] Int. Cl.[5] ..... A41D 13/00

[52] U.S. Cl. ..... 2/22

[58] Field of Search ..... 2/22, 24, 2

[56] References Cited

U.S. PATENT DOCUMENTS

| | | | |
|---|---|---|---|
| 2,640,989 | 6/1953 | Woodward | 2/22 |
| 3,189,919 | 6/1965 | Chase | 2/24 |
| 4,272,850 | 6/1981 | Rule | 2/24 |
| 4,627,108 | 12/1986 | Jarvinen | 2/24 |
| 4,715,067 | 12/1987 | Beauregard | 2/22 |
| 4,868,926 | 9/1989 | Lawson | 2/22 |
| 5,093,931 | 3/1992 | LaBerge et al. | 2/2 |

FOREIGN PATENT DOCUMENTS

| | | | |
|---|---|---|---|
| 2085708 | 5/1982 | United Kingdom | 2/24 |

*Primary Examiner*—Werner H. Schroeder
*Assistant Examiner*—Michael A. Neas

[57] ABSTRACT

This invention is a hinged knee joint for the ice hockey goaltender's protective leg pads. It is comprised of wedge shaped openings located in the side walls of the pad. These openings are covered with a protective plate that is attached to tracks to keep the plate flat against the sides of the pad and cover the openings during all possible degrees of movement.

1 Claim, 3 Drawing Sheets

FLEXUS MAXIMUS KNEE JOINT FOR GOALTENDER'S LEG PAD

This is a continuation-in-part of Ser. No. 07/604,074, filed Oct. 29, 1990 now abandoned.

BACKGROUND OF THE INVENTION

1) Field of Invention

The invention relates to the ice hockey goaltender's protective leg pads. The invention is a hinged knee joint that enables natural movement for the player's knees, without sacrificing any protection and without reliance on the breaking in, shifting or flexibility of the pad's side wall materials.

2) Description of Prior Art

The most commonly used goaltender's protective pad, is one that is made up of vertical columns stuffed with deer hair and horizontal columns across the knee. This placement of horizontal columns coupled with a very shallow channel for the player's leg affords satisfactory flexibility to the wearer's knee. However, in the newer flat, foam filled pads, the leg channel is very deep and the side walls of the pad are very distinguished. Regardless of how flexible the front panel is, the side walls make flexibility physically impossible.

SUMMARY OF THE INVENTION

This invention is a hinged knee joint for the ice hockey goaltender's protective leg pads. It allows for the full and natural movement of the knee without sacrificing any protection and without any shifting, stretching or breaking in of any materials. It also allows for flat portions of the pads that come in contact with each other, to remain flat during all degrees of movement.

DESCRIPTION OF THE PREFERRED EMBODIMENT

Figure 1A:
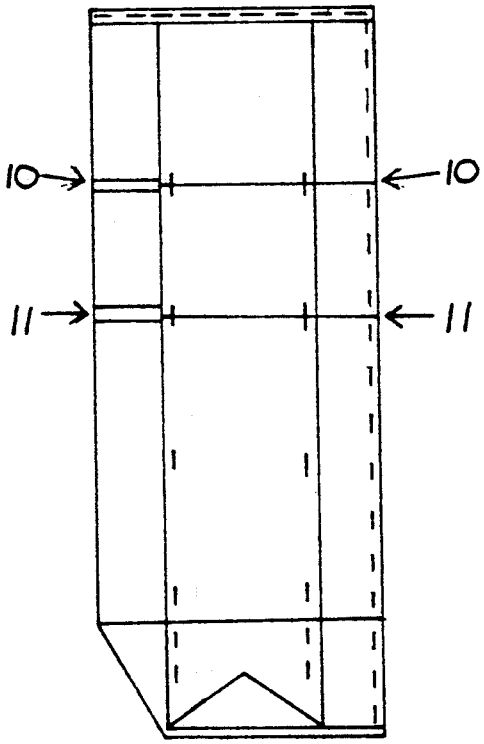
FIGS. 1*a* and 1*b* are front and back views of the leg pad, respectively.
Figure 1B:
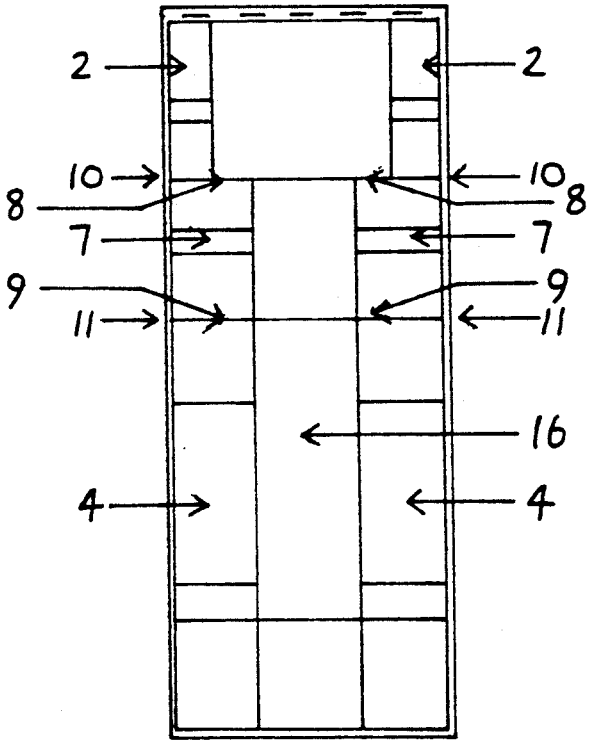

In FIG. 1*a*, the illustration is a full straight on view of the leg pad. Although no working parts of the invention are visible, the placement of the pivot points at which the knee bends are shown. FIG. 1*b* is a full straight on view of the back of the leg pad. Leg channel 16, is created by the presence of both the left and right thigh side wall 2, knee side wall 7 and shin side wall 4. Cut out of side walls 2, 7 and 4 are left and right, wedge shaped openings 8 and 9. Wedge shaped openings 8 and 9 pivot at left and right pivot points 10 and 11. Attached to left and right side walls 2, 7 and 4 are left and right knee plate 3.

Figure 2:
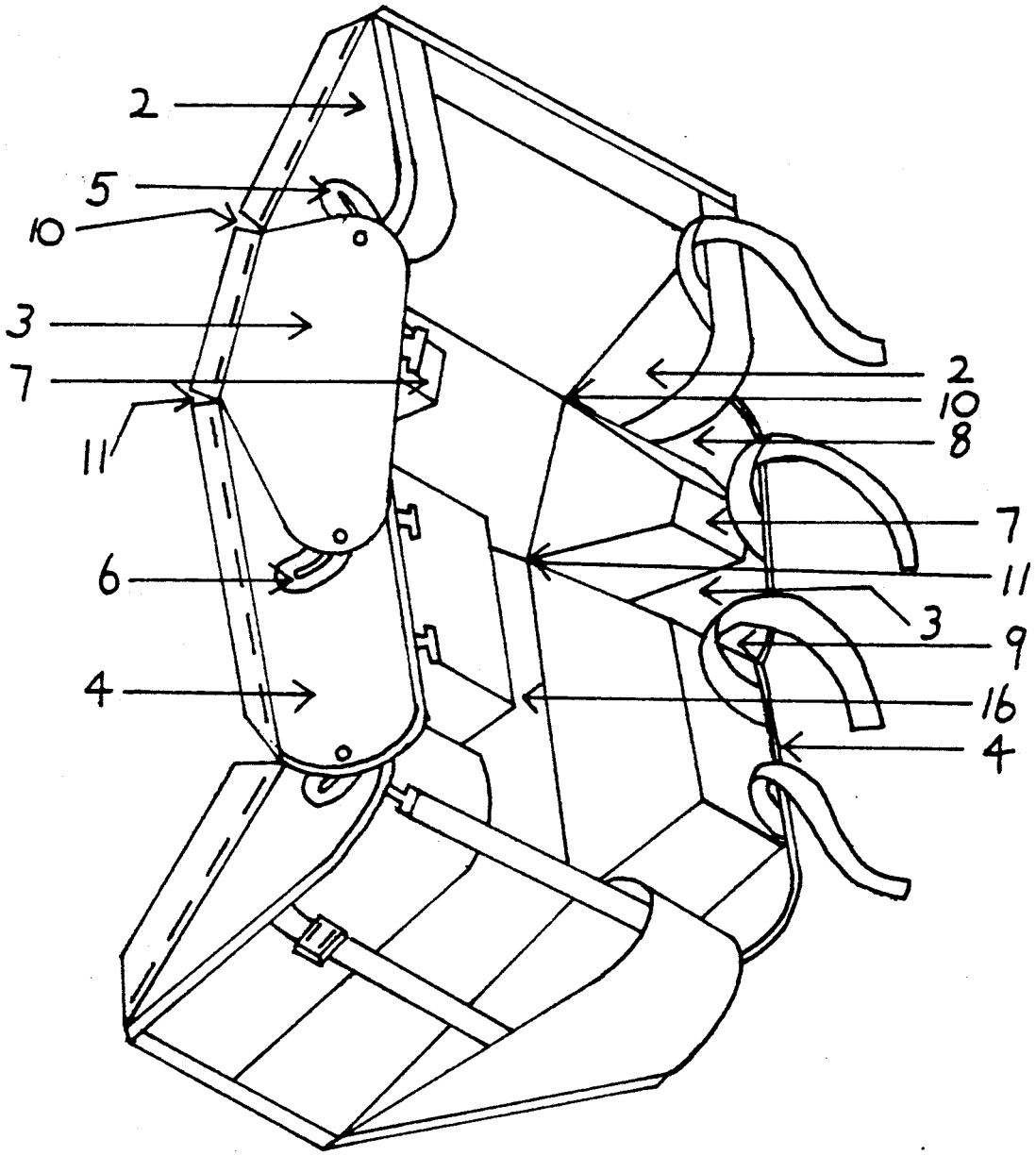
FIG. 2 is a perspective view showing the rear and one side of a leg pad made in accordance with present invention.

FIG. 2 is a perspective view showing the rear and one side of a leg pad. Leg channel 16 is formed by the presence of side walls 2, 7 and 4. Wedge shaped openings 8 and 9 are cut into side walls 2, 7 and 4. Wedge shaped openings 8 and 9 originate at point 10 where thigh side wall 2 connects to knee side wall 7 and at point 11 where knee side wall 7 connects to shin side wall 4. Closure of wedge shaped openings 8 and 9 pivot at respective points 10 and 11.

Wedge shaped openings 8 and 9 are covered from the outer side by protective plate 3. Protective plate 3 is attached the entire length between points 10 and 11. Protective plate 3 is also attached to tracks 5 and 6.

Figure 3A:
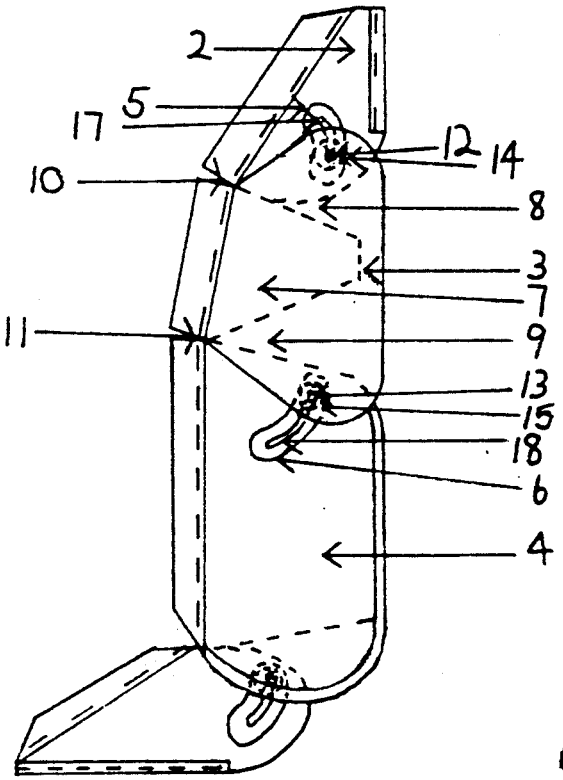
FIGS. 3*a* and 3*b* are two views of the same side illustrating the components of the knee joint while the leg pad is both erect and bent.
Figure 3B:
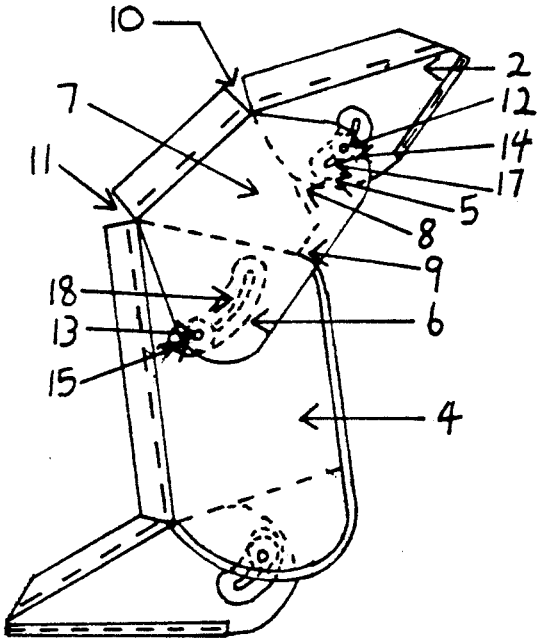

FIG. 3*a* is a side view of the leg pad when fully erect. Protective plate 3 overlaps thigh side wall 2 and shin side wall 4 as well as completely covering wedge shaped openings 8 and 9 along with knee side wall 7. Protective plate 3 is connected between pivot points 10 and 11. Protective plate 3 is also connected to the outline of knee side wall 7. Tracks 5 and 6 are each portions of circles with respective center of diameters at points 10 and 11. Tracks 5 and 6 are made of polyethylene plastic and each are sewn down around its respective outer edge. ¼" wide slots 17 and 18 are located ¾" in from all edges of respective tracks 5 and 6. 1¾" diameter washers 14 and 15 are located underneath respective tracks 5 and 6, each having the female portion of respective post binding screws 12 and 13 protruding through the center of respective washers 14 and 15 and respective slots 17 and 18. The male portion of respective post binding screws 12 and 13 enter downward through the top of protective plate 3 and then is attached to respective female post binding screws 12 and 13. FIG. 3*b* illustrates the same side view while the knee joint is completely flexed. Pivoting at points 10 and 11, wedge shaped openings 8 and 9 are completely closed. Protective plate 3 remains attached to the outline of knee side wall 7 during all degrees of movement. Washers 14 and 15 and post binding screws 12 and 13 while attached to protective plate 3 have moved through the entire lengths of respective slots 17 and 18 located in respective tracks 5 and 6. Illustrated is protective plate 3's ability to cover wedge shaped openings 8 and 9 during all degrees of movement while remaining flat against side walls 2, 7 and 4.

The embodiments of the invention in which an exclusive property or privilege is claimed as follows:

1. An ice hockey's goaltender's protective leg pad having a hinged knee joint comprising:

a) a front wall and a pair of side walls defining a leg channel, each side wall containing at least one wedge shaped opening in a vicinity of a wearer's knee so as to aid in flexibility;

b) a protective plate attached across said at least one wedge shaped opening and shaped so as to cover said at least one wedge shaped opening during all degrees of movement of the leg pad;

c) at least one arcuate track in a side wall portion adjacent each wedge shaped opening, each track and its corresponding inner slot having a radius that originates from a pivot point of its corresponding wedge shaped opening, said tracks allowing each protective plate and each side wall portion to pivot relative to each other;

d) each protective plate comprising a pivot screw assembly for engagement with each arcuate track associated therewith.

* * * * *